United States Patent [19]

Camp

[11] 3,948,132

[45] Apr. 6, 1976

[54] SLICING DEVICE

[75] Inventor: Clarence W. Camp, Burlington, Vt.

[73] Assignee: Edlund Company, Inc., Burlington, Vt.

[22] Filed: June 17, 1975

[21] Appl. No.: 587,612

[52] U.S. Cl. ..... 83/425.3; 83/431; 83/858

[51] Int. Cl.[2] ..... B26D 4/14

[58] Field of Search ..... 83/425.3, 431, 858, 425, 83/425.1, 425.2, 425.4

[56] References Cited

UNITED STATES PATENTS

| | | | |
|---|---|---|---|
| 1,748,997 | 3/1930 | Rentos | 83/425.3 X |
| 3,774,490 | 11/1973 | Gerson | 83/431 X |
| 3,807,266 | 4/1974 | Camp | 83/431 X |

*Primary Examiner*—Frank T. Yost

*Attorney, Agent, or Firm*—Kemon, Palmer & Estabrook

[57] ABSTRACT

An apparatus for slicing fruit and vegetables such as potatoes, carrots and onions as well as tomatoes and hard boiled eggs and the like. A set of parallel cutting blades are positioned in a horizontal plane within a frame member for initially receiving the article to be cut while an article engaging member or pusher is pivotally connected to said frame for engaging and forcing said article through said cutting blades.

7 Claims, 6 Drawing Figures

FIG. 1
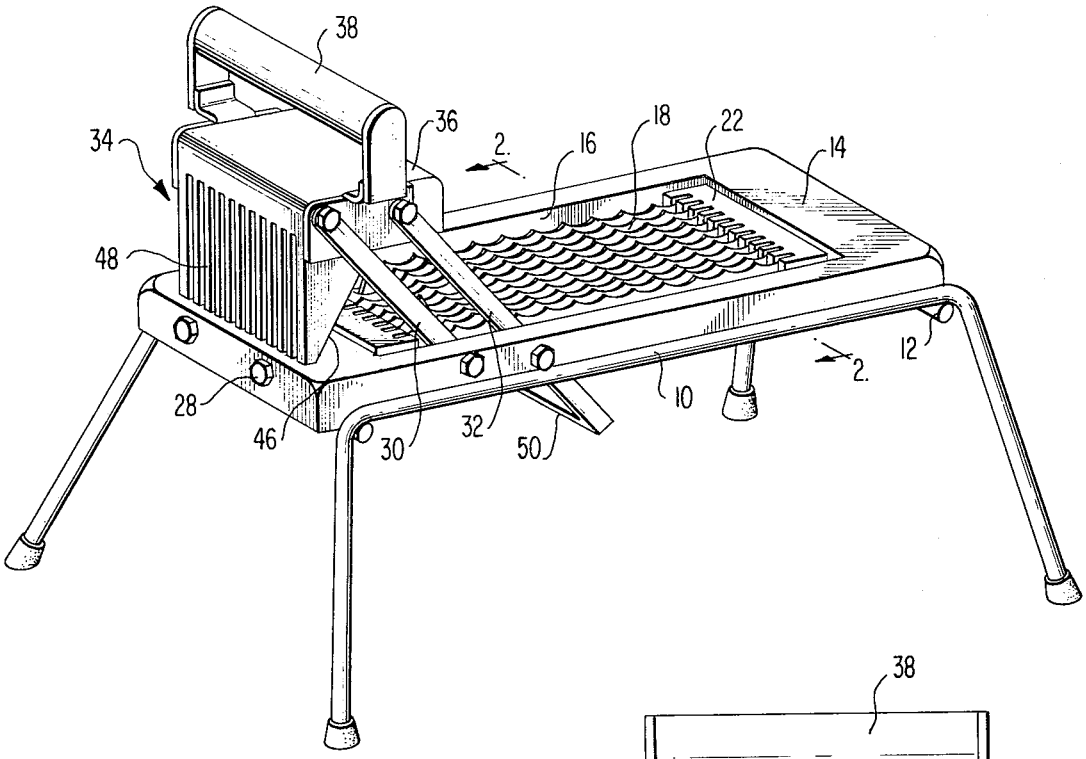
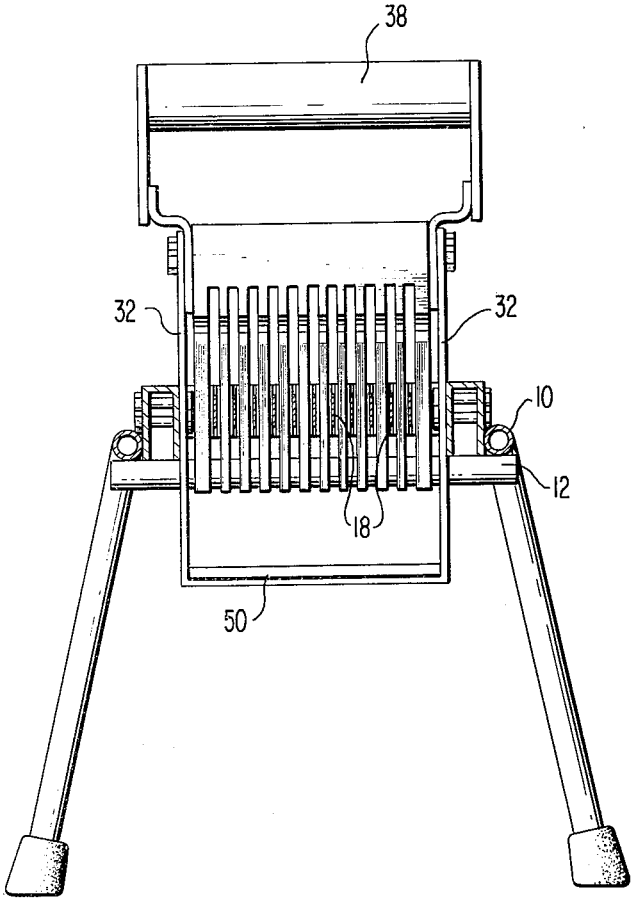
FIG. 2

FIG. 3
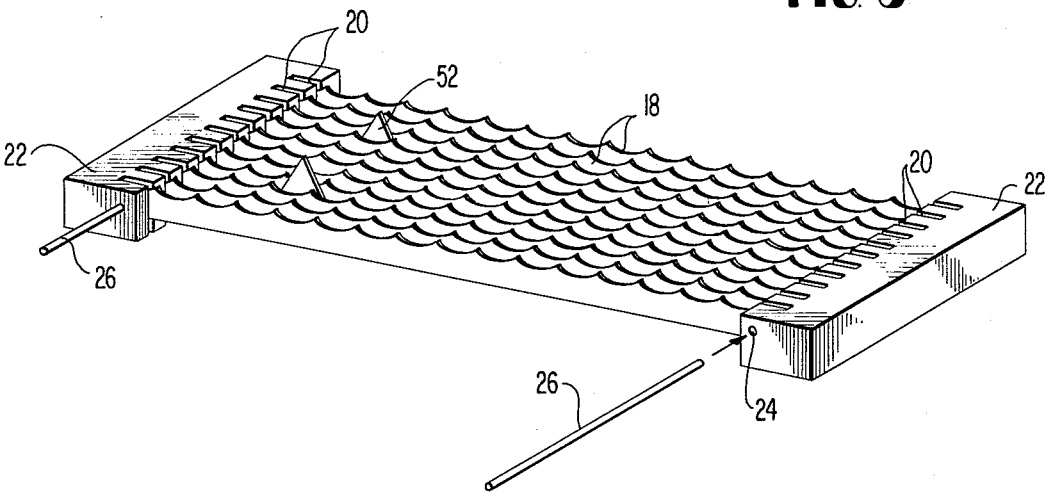
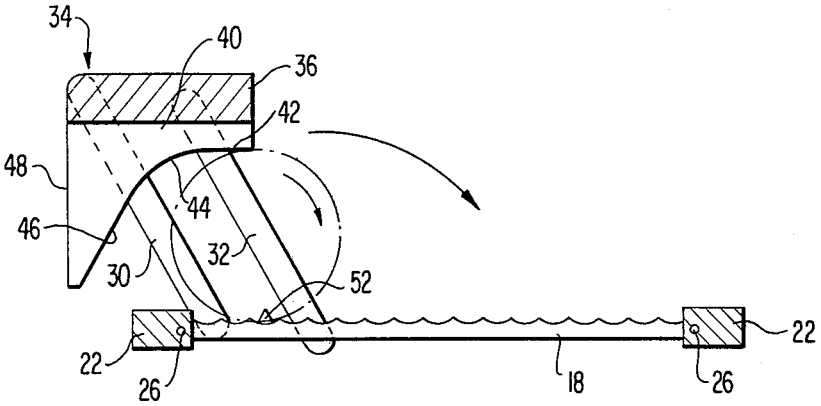
FIG. 4a
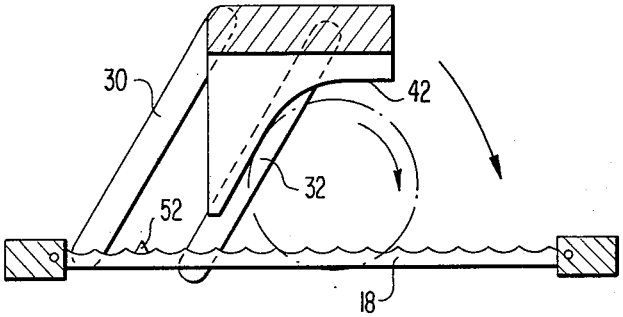
FIG. 4b
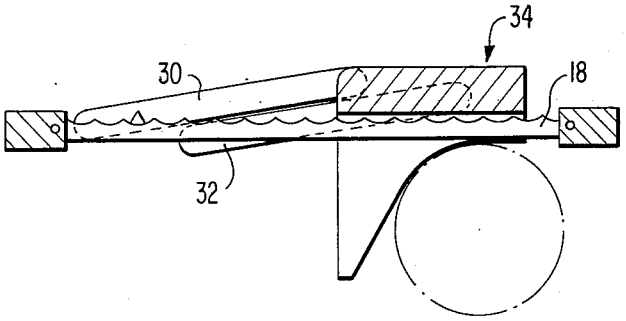
FIG. 4c

SLICING DEVICE

BACKGROUND OF THE INVENTION

The present invention is directed to cutting or slicing devices for use primarily in the culinary arts.

Devices and machines for cutting or slicing fruits and vegetables are old in the art and in fact certain well known hand-operated devices have been developed for cutting or slicing only tomatoes. In certain instances such devices usually have the cutting blades mounted in a vertical plane upon a suitable supporting base or platform. An article engaging or pusher device is usually mounted on or in said base or platform for sliding movement with respect thereto contemporaneous with engaging the article to be cut or severed. In lieu of slidably mounting the pusher element upon the supporting base said pusher element may be pivotally mounted upon the base whereby the pusher element will, either swing or move through the fixed cutting blades.

In certain prior art devices such as MORRETT, U.S. Pat. No. 3,605,840, dated Sept. 20, 1971, reference is made to rotating the article supported on the cutting knives or blades by the pusher element just prior to forcing the article through the fixed cutting knives. In the prior art patent to GIANGIULIO, U.S. Pat. No. 3,365,582, dated Feb. 20, 1968, the article to be cut, namely, a tomato is pushed through the fixed cutting knives without any attempt being made to rotate the tomato. In fact GIANGIULIO seems to be more concerned in moving the tomato into and through the fixed cutting knives without any rotation of the tomato. In GERSON, U.S. Pat. No. 3,605,839, dated Sept. 20, 1971, the pusher or article engaging member is pivotally mounted on one side of the fixed cutting blades and arranged to extend through said blades for moving an article into engagement with the blades on the side opposite from the pivot point of the pusher.

In the various instances enumerated the article has been pushed through the fixed cutting blades utilizing article engaging or pushing members of varying types. The consensus regarding the mode of operation seems to be that articles, such as tomatoes with their relatively thick skins, should be pushed through the fixed cutting blades with a slight amount of rotation of the article, in certain instances, to enhance the slicing operation.

SUMMARY OF THE INVENTION

The present invention is directed to a slicing device that is readily capable of slicing tomatoes and which includes a frame for supporting a plurality of fixed cutting blades. A plurality of link elements are pivotally connected to said frame with an article engaging or pusher member pivotally connected to said link elements. The frame and article engaging or pusher member when connected to one another by the link elements tend to define a parallelogram in that the pivot points are maintained at a fixed distance from one another. The manner of connecting the pusher member to the link elements causes a certain segment or surface of said pusher member to move in a path wherein said segment or surface is disposed in a series of horizontal planes that are parallel to the horizontal plane of the cutting blades. Thus said segment or surface engages the surface of the tomato being sliced only during the final stages of the slicing operation.

BRIEF DESCRIPTION OF THE DRAWING

FIG. 1 is a perspective view of the slicing device embodying the present invention;

FIG. 2 is a vertical sectional view of the slicing device of the present invention;

FIG. 3 is a perspective view of the cutting blades and holder;

FIG. 4A is a side elevational view of a portion of the slicing device of the present invention showing one position of the article on the cutting blades and the pusher member engaging said article;

FIG. 4B is a view similar to FIG. 4A but showing the article in its initial stages of being sliced; and FIG. 4C is still another view similar to FIG. 4A but showing the article after it has been moved through the cutting blades.

DESCRIPTION OF THE PREFERRED EMBODIMENT

Referring to the drawing there is shown in FIG. 1 a tubular frame member consisting of elongated side pieces 10 terminating in downwardly extending leg elements and which side pieces are connected by transverse end members 12. The tubular frame members has supported thereon a base or platform member 14 which is formed with a centrally disposed rectangularly shaped opening 16 for receiving a plurality of fixed cutting blades or elements 18.

The cutting blades 18, FIG. 3, are arranged in spaced parallel relation with respect to one another and the respective ends of each blade are positioned in slots 20 formed in the innermost faces of header members 22. The header members 22 are formed with longitudinally extending bores 24 which intersect the slots 20 for the reception of retaining rods 26. Each of the cutting blades 18 is formed with a suitable aperture at each end so that said blades may be anchored in the headers 22 by means of the rods 26 extending through the bores 24 in the headers and also passing through the openings in the ends of the cutting blades 18. The header members 22 with the cutting blades 18 assembled therein are positioned within the rectangular opening 16 in the base or platform member 14. The header members are anchored or secured in said base or platform member by fastening elements 28 that extend through apertures in the ends of the base or platform member 14 and project into suitable recessed bores, not shown, provided in the ends of the headers 22. Thus upon adjustment of the fastening elements 28 adequate longitudinal tension may be maintained on the various cutting blades 18 as same are retained in the headers 22. While only one pair of fastening elements 28 is shown in FIG. 1, it is to be understood that the other end of the base or platform member 14 is also provided with similar types of fastening elements which engage recessed bores provided in the end of the other header member 22. Thus the longitudinal tension that may be maintained on the cutting blades 18 may be provided by adjusting the fastening elements 28 at one or both ends of the base or platform 14.

The base or platform member 14, FIG. 1, has pivotally mounted thereon, adjacent one end of the opening 16, a pair of link members or elements 30, only one of which is shown in FIG. 1. A second pair of link elements or members 32, only one of which is shown in FIG. 1, are pivotally connected to the base or platform member 14 adjacent one end of the rectangular opening 16. The free ends of the link elements or members 30 and 32 are pivotally connected to an article engaging or pusher element 34. The pusher element 34 is formed with a substantially rectangular solid upper portion 36 whose width is substantially the same as the width of the header members 22. The portion 36 of the pusher element 34 is the part to which the upper ends of the links 30 and 32 are pivotally connected by suitable fastening elements and in addition a handle 38 is connected to said upper portion 36.

The lower face of the portion 36 of the pusher element 34 is provided with a plurality of integrally formed impeller or pusher blades 40 that are arranged in spaced parallel relation with respect to one another and are adapted to enter the spaces that are defined by the cutting blades 18 carried in the headers 22 when said cutter blades and headers are positioned in the base or platform member 14 in the manner as illustrated in FIG. 1. The impeller or pusher blades 40, depending from the upper portion 36 of the pusher element 34, are at the forward end of the pusher element of uniform depth so as to define or provide a relatively flat surface or area 42, FIGS. 4A and 4B. The impeller or pusher blades 40 from the flat surface or area 42 merged into an arcuate segmental portion 44 which terminates in a downwardly inclined rear segment or portion 46 which inclined rear segment or portion is disposed at an angle of approximately 60° to the horizontal. The rearmost edge or face of each impeller blade 40 terminates in a vertical surface 48, FIGS. 1 and 4, so that the rearmost edge or surface of each of the impeller or pusher blades 40 terminates in the same vertical plane which is disposed at right angles to the topmost surface of the upper portion 36 of the pusher element 34.

The link element 32 is formed as a single U-shaped member that is pivotally connected to the base or platform member 14 so that a segmental portion of said link element projects below the base or platform member 14 in the manner as shown in FIGS. 1 and 2. This lower segmental portion of the link element 32 acts as a stop member by engaging the under surface of the base or platform 14 upon the pivotal movement of the article engaging or pusher element 34 and thus maintains the upper portion 36 of the pusher element 34 in spaced relation to the cutting blades 18 when the pusher element 34 has reached the end of its travel or approaches the position as shown in FIG. 4C. A pair of positioning members 52 are affixed to certain of the cutting blades 18, FIGS. 3 and 4A, adjacent one of the headers 22 for initially positioning the article that is to be sliced upon the cutting blades.

In the use of the slicing device of the present invention, the cutting blades 18, with the positioning members 52 mounted on certain of the blades, are secured to the headers 22 by means of the retaining rods 26. The headers are then positioned within the rectangular opening 16 of the base or platform member 14 where they are retained by the fastening elements 28 which also apply necessary tension to the cutting knives in the securing of the headers to the base or platform 14. The article engaging or pusher element 34 is pivotally mounted on the base or platform member 14, and, as illustrated in FIG. 1, said pusher element, in its inoperative position, tends to overlie the header member 22 and the portion of the base or platform member 14 at the left hand end of said base or platform when viewing FIG. 1. By so positioning the pusher element 34 over the base or platform member 14 and the header 22 practically the entire area of the cutting knives is free of any obstruction and readily permits the placing of the article that is to be sliced upon the positioning members 52.

Assuming that the article so positioned on the members 52 is a tomato the handle 38 is then grasped by the operator and moved from the left to the right, when viewing FIG. 1, so that the pusher member 34 is moved upwardly and forwardly due to the fixed link members 30 and 32 being pivotally connected to the base or platform member 14. As the pusher element 34 moves upwardly and forwardly the flat surface 42 of the impeller or pusher blades 40 initially overlies the top surface of the article that is to be sliced and this is the position that is substantially illustrated in FIG. 4A. The continued movement of the pusher element 34 through the handle 38 causes the pusher element to be elevated to a still higher point as the links 30 and 32 move about their pivot point with the base or platform member 14 so that when the links 30 and 32 are in a vertical position with respect to the base or platform 14, the pusher element 34 is at the highest point of its travel. As the pusher element is being elevated by the pivotal movement of the links 30 and 32, the arcuate segmental portion 44 of the impeller or pusher blades 40 will engage the article supported on the positioning members 52 of the cutting blades 18 and impart a rotative movement to said article while at the same time applying pressure to the article so as to force same into engagement with the cutting edge of the blades 18.

The continued movement of the pusher member 34 will continue to apply pressure to the article that is to be sliced so that the arcuate segmental portion 44 of the pusher element 34 will tend to cup the article being sliced and to force same against the cutting knives 18 in a somewhat downwardly direction so that the pressure on said article is in an angular direction with respect to the horizontal surface of the cutting blades 18. The continued movement of the pusher element 34 will cause the links 30 and 32 to move from their most vertically extended position to an inclined position towards the right hand end of the base or platform 14, when viewing FIG. 1, so that the inclined rear segmental portion 46 of the impeller blades 40 will then be assisting the arcuate segmental portion 44 of said blades in engaging the article to be sliced and in forcing said article against the cutting knives 18. This position of the pusher element 40 is more or less illustrated in FIG. 4B. At this particular point the cutting knives have penetrated the article to be sliced and the continued movement of the pusher element 34 through the link elements 30 and 32 causes the impeller blades 40 to force the article through the cutting knives 18 until such time as the solid upper portion 36 of the pusher element 40 is disposed in close proximity to the upper surface of the cutting blades 18. The portion 36 of the pusher element 34 is maintained in spaced relation to the upper surface of the cutting blades 18 by the segmental portion 50 of the link 32 moving about the pivotal connection of said link with the base or frame member 14 in such a manner that the segmental portion 50 strikes the lower surface of the base or platform 14 and thus acts as a limit stop for the movement of the pusher element 34.

It is to be noted that the pusher element 34 in conjunction with the base or platform 14 and the link elements 30 and 32 tend to define a parallelogram and in view of this arrangement the upper portion 36 of the pusher element 34 is always maintained in a horizontal plane that is parallel to the horizontal plane of the cutting knives 18 and base or platform 14. This movement of the pusher element 34 through the links 30 and 32 and its relationship with the base or platform 14 is clearly illustrated in FIGS. 4A, 4B and 4C. The positioning of the article, such as a tomato, upon the members 52 tends to prevent said article from sliding along the upper surface of the cutting blades 18 when said article is engaged by the pusher element 34. Thus as the pusher element is moved through its path of travel by the link elements 30 and 32 the various surfaces or areas of the impeller or pusher blades 40 will engage said article to initially impart a rotating motion to said article contemporaneous with the application of pressure thereto which will result in a penetration through the rind or tough outer skin of the article by the cutting edges of the blades 18 resulting in the severing of the article into a plurality of slices as said article passes through the spaces between the adjacent cutting blades.

Although the foregoing description is necessarily of a detailed character, in order that the invention may be completely set forth, it is to be understood that the specific terminology is not intended to be restrictive or confining, and that various rearrangements of parts and modifications of detail may be resorted to without departing from the scope or spirit of the invention as herein claimed.

What I claim:

1. A slicing device comprising an elongated base, a plurality of horizontally disposed cutting blades mounted in said base for receiving an article to be sliced, an article engaging member, a plurality of link elements arranged in spaced parallel relation to one another and connected to said article engaging member and said base for moving said article engaging member from one end of said base towards the other end contemporaneous with the forcing of said article through said knives for slicing same and while maintaining said article engaging member in planes parallel to the plane of said base and cutting blades.

2. A slicing device as set forth in claim 1 wherein said article engaging member is provided with a plurality of depending parallel pusher blades which have an arcuate segmental portion and an inclined segmental portion for engaging and forcing said article through said cutting blades.

3. A slicing device as set forth in claim 1 wherein said article engaging member and said base and said link elements constitute a parallelogram in the movement of said article engaging member with respect to said base.

4. A slicing device as set forth in claim 1 wherein certain of said cutting blades are provided with article positioning members.

5. A slicing device as set forth in claim 1 wherein one of said link elements is formed with a depending portion that engages said base and acts as a stop for said article engaging member.

6. A slicing device as set forth in claim 1 wherein said base is supported on a rectangularly shaped tubular frame member.

7. A slicing device as set forth in claim 2 wherein the upper surface of said article engaging member is initially raised with respect to said cutting blades and then maintained in an elevated position prior to being lowered with respect to said blades.

* * * * *